United States Patent [19]

Winter et al.

[11] 4,430,870

[45] Feb. 14, 1984

[54] CONTROL ARRANGEMENT FOR A ROTATABLE WINDING ARRANGEMENT

[75] Inventors: Karl Winter; Friedrich Gille, both of Obertshausen; Hans Lotz, Muhlheim, all of Fed. Rep. of Germany

[73] Assignee: Karl Mayer Textilmaschinfabrik GmbH, Fed. Rep. of Germany

[21] Appl. No.: 359,994

[22] Filed: Mar. 19, 1982

[30] Foreign Application Priority Data

Mar. 20, 1981 [DE] Fed. Rep. of Germany ..... 3111113

[51] Int. Cl.[3] ..... D04B 27/10

[52] U.S. Cl. ..... 66/210; 66/203

[58] Field of Search ..... 66/132, 157, 163, 203–212

[56] References Cited

U.S. PATENT DOCUMENTS 3,780,541 12/1973 Haynes ..... 66/132

3,961,500 6/1976 Braley ..... 66/210

FOREIGN PATENT DOCUMENTS 510545 6/1976 U.S.S.R. ..... 66/211

*Primary Examiner*—Ronald Feldbaum

*Attorney, Agent, or Firm*—Omri M. Behr

[57] ABSTRACT

In a control arrangement for the motor of a winding arrangement, such as a partial warp beam in a warp knitting machine, there is provided a controller. The controller controls the rate of rotation of the motors of the turning arrangements that influence thread consumption and ware takeoff, in dependence on a main shaft signal, a feedback signal and an input size signal. The control arrangement is equipped for the storage of a program containing many input sizes which are addressable sequentially for the control arrangement, in dependence upon the main shaft signal. In particular, a data memory may be provided with a plurality of addresses for the production of differentiable input sizes. An address caller is controlled by the main shaft signal and calls out sequentially the different input sizes for the control arrangement. As a controller, a digital computer is foreseen.

16 Claims, 3 Drawing Figures

CONTROL ARRANGEMENT FOR A ROTATABLE WINDING ARRANGEMENT

BACKGROUND OF THE INVENTION

1. Field of the Invention

The present invention relates to control arrangements for rotation of a winding arrangement such as a partial warp beam in a warp knitting machine. The present invention also relates to apparatus for varying the thread consumption rate and/or the ware takeoff rate in a knitting machine to produce a predetermined patterning effect in the knitted ware.

2. Discussion of the Relevant Art

A known control arrangement, DE-OS No. 2,351,431, employs two pulse generators, one attached to and driven by the main shaft and the other driven by a follower roller running on the circumference of the winding of a partial warp beam. The input arrangement permits manual input of a predetermined input size which determines how much thread length will be delivered from the partial warp beam for each revolution of the main beam. The controller comprises a phase comparator which controls a digital/analog converter via a forwards/backwards counter. This apparatus operates on the warp beam motor via an amplifier.

There is a need for a control arrangement of the heretofore described type in which the patterning programs for goods produced on the warp knitting machine can be substantially increased.

SUMMARY OF THE INVENTION

A control arrangement according to the principles of the present invention operates with a motor of a rotatable winding arrangement in a machine such as a textile or knitting machine, having a main shaft. The control arrangement has a first and second signal generator. The first signal generator is coupled to the machine for generating a main shaft signal signifying the angular displacement of the main shaft. The second signal generator is coupled to the rotatable arrangement for generating a feedback signal bearing a predetermined relation to the extent of rotation of the rotatable arrangement. The control arrangement also includes an input means coupled to the first signal generator and programmed to provide an input size signal that varies in response to the main shaft signal. Also included is a control means coupled to the input means and the first and second signal generators for controlling the angular speed of the motor of the rotatable arrangement in response to the main shaft signal, the feedback signal and the input size signal. Thus the programmed input means can change the angular speed of the rotatable arrangement.

Thus, in a preferred embodiment, a first signal generator yields the main shaft signals characterizing the turning angle of the main shaft, and the second signal generator can give a feedback signal depending upon the turning of the turning arrangement. The preferred input arrangement can set input sizes and cooperate with a control means which, in dependence upon the main shaft signal, the feedback signal, and the input amounts control the number of revolutions of the turning arrangement.

It is particularly advantageous if the controller controls the motors both for the thread letoff as well as for the ware takeoff and that the input arrangement is equipped for the storage of a common program for both of these motors. If, within the context of this program, the thread letoff as well as the ware takeoff is to be influenced, one is provided with a heretofore unavailable variety of pattern arrangements in the stitcher.

It is preferred that the controller is provided as a digital computer and the input arrangement digitally provides the setting sizes. In this manner it is possible to provide many setting sizes to the control arrangement in a very simple manner.

BRIEF DESCRIPTION OF THE DRAWINGS

In order that the invention may be more fully understood, it will now be described, by way of example, with references to the accompanying drawings in which.

DESCRIPTION OF THE PREFERRED EMBODIMENTS

Figure 1:
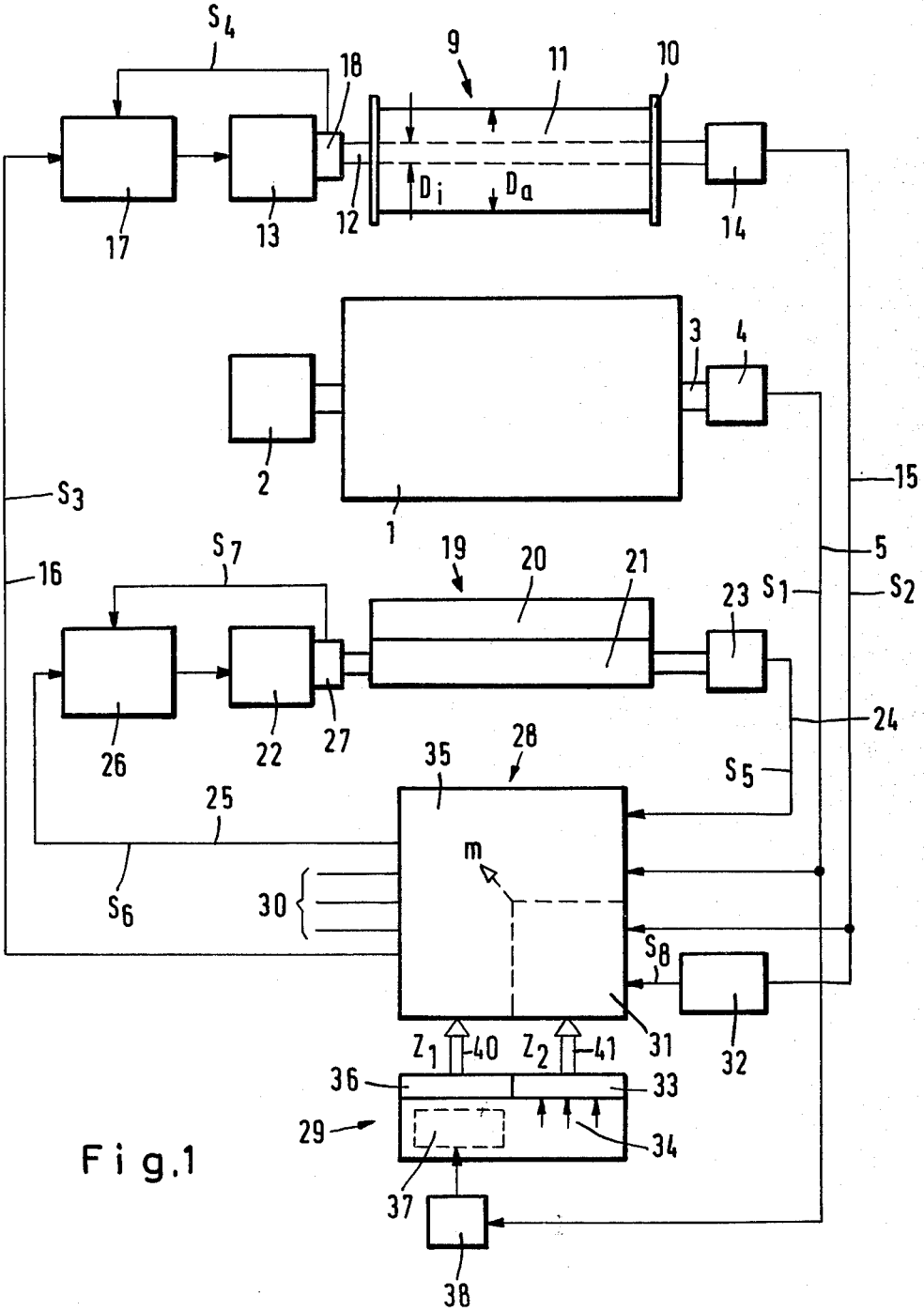
FIG. 1 is a schematic representation of the control arrangement according to the principles of the present invention.
Figure 2:
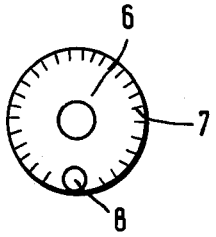
FIG. 2 is a schematic representation of a pulse generating signalling device.

Referring to FIG. 1, warp knitting machine 1 comprises drive motor 2 and main shaft 3 which controls all of the apparatus of machine 1 concerned with the work cycle of the knitting needles (not shown). Rotational angle measuring means 4 is connected with main shaft 3 and generates main shaft signal S1. Signal S1 comprises pulses, that is to say, a single pulse for each predetermined angular increment of rotation. Signal S1 is transmitted over lead 5. For example, rotational angle measuring means 4 can have the form shown in FIG. 2 wherein the disc 6 has a plurality of equi-distant indicia 7 which can be detected by an electro-optical converter 8, such as a photoelectric transistor. Disc 6 is driven by main shaft 3 (FIG. 1) to produce a pulse from converter 8 whenever shaft 3 advances by a predetermined increment. These readout signals can also be generated by other means, for example, magnetic, mechanical or electrical means to yield means equivalent to first signal generator 4.

Warp knitting machine 1 is provided with a delivery means 9 for the delivery of thread. In this embodiment arrangement 9 is shown as partial warp beam 10, although other types of warp beams are contemplated. Partial warp beam 10 has warp threads wound upon it as winding 11. Partial warp beam 10 is driven via shaft 12 by DC motor 13. The shaft 12 is also connected with a rotational angle measuring means 14 which has the same construction as angle measuring means 4. Thus, via line 15, there is generated a feedback signal S2, which again comprises a series of pulses each signifying a small angular increment of rotation of beam 10 (from second signal generator 14).

The desired rate of rotation of motor 13 is specified by rotational signal S3 on line 16 which can constitute, for example, a variable input voltage. The rate of rotation of motor 13 is measured by tachometer 18 connected to shaft 12 to produce a feedback signal S4. The line bearing signal S4 is connected to one input of DC amplifier 17, its other input 16 being connected to the line bearing signal S3. Amplifier 17 is connected to motor 13 to regulate its speed. Thus connected, DC amplifier 17 forms a small control circuit, feedback signal S4 from the tachometer acting with motor 13 to provide rate feedback.

Warp knitting machine 1 is further provided with ware takeoff means 19, shown herein as two rollers 20 and 21, the latter directly driven and the former indirectly driven by drive motor 22. Also, rotational angle measuring device 23 connected to roller 21 to rotate therewith, generates on line 24 feedback signal S5 in the form of a series of pulses signify angular, incremental rotation of roller 21. The angular speed of motor 22 is prescribed by a turning signal S6 on line 25 which may comprise a variable DC potential. This signal S6 is fed to input 25 of DC amplifier 26 whose other input connects to the output of tachometer 27. Tachometer 27 is mechanically coupled to motor 22 to produce feedback signal S7. The output of amplifier 26 is connected to motor 22 to regulate its speed. Thus connected amplifier 26 and tachometer 22 are part of a rate feedback loop for maintaining the speed of motor 22 according to the signal S6. The direction of rotation of elements 10 and/or 21 can be sensed by producing from generators 14 and 23, respectively, differentiable pulses whose production depends on the direction of rotation. The differentiable pulses can be, for example, positive and negative pulses. Alternatively, signals S2 and/or S5 can be multiplexed signals or signals on multiple lines so the directional information can be separately sensed.

A control means is shown herein as computer 28. Its inputs include lines 24, 15 and 5 and its outputs include lines 25 and 16. Outputs 30 of computer 28 indicate that computer 28 can be used as a control means for other rotating arrangements; for example, other partial warp beams provided with control circuits. Computer 28 cooperates with an input means 29 which provides input data on buses 40 and 41. While in some embodiments arrangement 29 can be a digital computer or an analog signal generator, in this embodiment arrangement 29 is a digital memory, preprogrammed as set forth hereinafter. The data memory of input arrangement 29 has a plurality of addresses for the storage of different setting sizes and these addresses are called according to main beam signals S1 to change the settings for the control arrangement as explained further hereinafter. By choice of the appropriate addresses, the appropriate setting size for the desired work cycle may be provided to affect motor 13 and/or 22 as explained further hereinafter. Therefor the setting size signals Z1 can comprise more than one class of data. Another possibility exists wherein input arrangement 29 is provided with a computation means which, in dependence upon main shaft signal S1, calculates different setting amounts dependent upon a preset calculation program. The foregoing setting sizes Z1 determine what length of thread should be delivered per revolution of main shaft 3 from warp beam 10.

The computer 28 with input means 29 and selector 38 is assembled as an 8 bit microprocessor from an INTEL 8041 UPI Microcomputer and an INTEL 8039 RAM EPROM, both manufactured by INTEL Corporation, Santa Clara, Calif.

Input means 29 is also arranged to provide calculating constants and similar data along buses 41. As explained further hereinafter the data Z2 together with the turning angle signal S2 of line 15 permit calculation of the measured, actually delivered, thread length from beam 10.

A portion 31 of computer 28 is used to calculate process variable m, a scaling quantity indicating the length of thread currently delivered for each pulse of turning signal S2. To this end, the output of counter 32 is connected to portion 31. The input of counter 32 is connected to line 15 to receive feedback signal S2. Counter 32 is an up/down counter whose mode of counting depends upon the information supplied by the feedback signal S2 about the turning direction of warp beam 10. Thus, counter 32 is incremented or decremented according to the angular rotation of beam 10 to exhibit a count signifying the net angular displacement of beam 10. This feature is useful if beam 10 should reverse direction. Also given to calculating means 31 as input data Z2 are the following: internal diameter D1 of winding 11 (that is, the diameter of the warp beam axis), the outer diameter Da of winding 11 and the number of layers of winding. Instead of providing the outer diameter Da, it can be calculated from the thickness and the number of the layers. Other combinations of known quantities may also be utilized. Such data may be fed into portions 33 of the input arrangement 29 by means of a setting arrangement 34. This data from setting arrangement 34 may originate from external or internal data logs, may be established manually or by other means, when the warp beams or the patterns are changed.

To obtain the measurement size m the computer 28 operates in accordance with the following formula:

$$m(l) = \frac{\pi a_0}{360}\left(Da - \frac{d\Sigma a_0}{360}\right) \quad (1)$$

Wherein, m(l) is the thread length delivered for each pulse of turning angle signal S2; $\alpha_0$ is the angular increment for each pulse; Da is the outer diameter of the winding 11; and d is the thickness of the winding layer.

The summation of the turning angle $\alpha_0$ occurs in counter 32 so that the sum of the turning angles with respect to 360° is equal to the number of rotations of the warp beam 10 during the foregoing letoff. Of course in other embodiments this summation can be performed within computer 28.

This process variable m is compared with the input size signal Z1 and the main beam signal S1 in computer 28 in such a manner that the turning signal S3 is adjusted to cause a predetermined thread length for each revolution of main shaft 3. This setting size signal is found in portion 36 of the input arrangement 29 and is read from data memory 37 in dependence upon address selector 38. The address selector is controlled by the main shaft signal S1. As an example, for patterning knitted goods two or more setting size signals can be transmitted from data memory 37 into input portion 36 in accordance with a program of a predetermined number of revolutions of main shaft 3. Accordingly, a pattern is developed over successive working cycles of warp knitting machine 1.

In a similar manner, feedback signal S5 of takeoff means 19 is compared in computer 28 with the main shaft signal S1 and the appropriate setting size Z1 so that the turning count signal S6 leads to a predetermined amount of rotation of rollers 20 and 21 for each revolution of the main shaft 3.

In operation, computer 28 responds to shaft signal S1 and feedback signals S2 and S5 and the data which are generated by input arrangement 29, to produce the desired rotational speed signals S3 and S6 for motors 13 or 22 as follows: Assuming that computer 28 has recently generated a signal on lines 25 and 16, motors 22 and 13, respectively, are held by the inner loop including tachometers 27 and 18, respectively, to velocities proportional to signals S6 and S3, respectively. When the next pulse is applied along line 15 to counter 32, its count increases by one. Consequently computer 28 can either immediately or within a programmed time period, recalculate the value of the process variable m according to equation 1. Since the summation continually increases, the value of m continually decreases, indicating the need for a higher angular speed for warp 10 as it unwinds, to maintain a constant rate of thread consumption. Computer 28 measures the number (or frequency) of pulses in line 15 over a given number (or portion) of machine cycles, as determined by the pulses of main shaft signal S1. For example, computer 28 can keep a running total by incrementing the total by the current value of m everytime a pulse appears on line 15. Were this total kept for 480 courses, the total would be equivalent to rack length. However, it is expected that the thread consumption will be examined more frequently to increase response time. In any event, the consumption value thus obtained is compared to the thread consumption required by setting size signals Z1. If the measured consumption is in error due to, for example, a reduction in the diameter of warp 11, computer 28 adjusts the signal on line 16 to adjust the speed of motor 13 accordingly until the desired and measured consumption coincide. At the same time the number (or frequency) of pulses on line 24 over a number, or portion, of a machine cycle as indicated by the main shaft signal S1 is measured. This measurement, equivalent to measured takeoff rate, is compared to a corresponding takeoff value among setting size signals Z1 to adjust motor 22 in a fashion similar to motor 13.

It will be appreciated that the measurement of rates by totalling pulses is equivalent to measuring a ratio and can be performed in other ways. For example, the periods of different pulse trains can be measured and converted to a ratio directly by a dividing subroutine in computer 28.

Eventually address selector 38 observes that a predetermined number of machine cycles has elapsed. Thereafter selector 38 calls for the next values for setting size signals Z1. These changes cause corresponding changes in the speeds of motors 13 and 22. Thus input arrangement 29 provides for a program with many input sizes which can be called out sequentially by the control arrangement 29 in dependence upon main shaft signal S1. Accordingly, warp knitting machine 1 is driven with a substantial number of differences of rotational rates of its rotating elements. The switch from one rate of revolution to the other proceeds automatically upon receipt of the main shaft signal which, in any event, must be provided for other reasons. It therefore becomes possible, by the alteration of the rate of rotation of the partial warp beam 10 (or warp beam) to produce goods which, within itself contains sections having loose stitches, tight stitches, and stitches with intermediate tension. It is thus possible to produce within the goods itself variations of thread density, the appearance of pleats, and the like. All of this can occur automatically by means of such a program. Since not merely warp beam 10 (or other important arrangements for the provision of thread) is affected but also the ware removal arrangement 19 by altering the rate of rotation of the ware removal arrangement, it is possible to influence the tension in the ware takeoff; in which event the fabric itself may be influenced.

The foregoing operation is accurate since feedback signal S2 is particularly accurate for characterizing the turning angle of turning arrangement 9. Accuracy is high, for one reason, because the system is not dependent upon assistance from a following roller. Furthermore, feedback signal S2 can also characterize the direction of rotation when the drive means 13 is drivable in both directions of rotation. Instead of roller measurements, the turning angle feedback signal S2 of a warp beam (or a partial warp beam), is measured and supplied to calculating arrangement 28 before generating a controlling input. Thus thread is not physically contacted and the thread lengths are calculated utilizing input data from input arrangement 29, based upon the diameter of the wind 11 and the value of the thickness of each winding layer. In this way it is possible to determine the appropriate measurement size precisely even though the pulled off thread length is not proportional to the turning angle S2 but must depend upon the appropriate diameter of the wind 11. Since the reduction of the wind diameter is proportional to the rotation of the winding arrangement it is possible to use the turning angle feed back signal S2 not only as the initial value for the calculation of the thread length but also as a correction value for taking into account the altering winding diameter. It is thus possible to obtain a measuring value with an error of less than 1%.

The foregoing operation can be altered so that in another embodiment motor 13 (and/or motor 22) for the turning arrangement can also be designed to permit running in reverse. To this end the setting amounts in the program of memory 37 can include at least one value which causes motor 13 to run in reverse. It is also advantageous to insert into the program at least one setting value which cause motor 13 and/or 22 to stop. In this manner, several additional patterning possibilities may be achieved, especially with elastic threads. It is possible, by such braking or backwards running of thread feed mechanism drive motor 13 to achieve a stretching of elastic threads. Conversely by braking or running backwards the mechanism for ware take-off, it is possible to release the tension in the goods and this may also be used for patterning effects.

Figure 3:
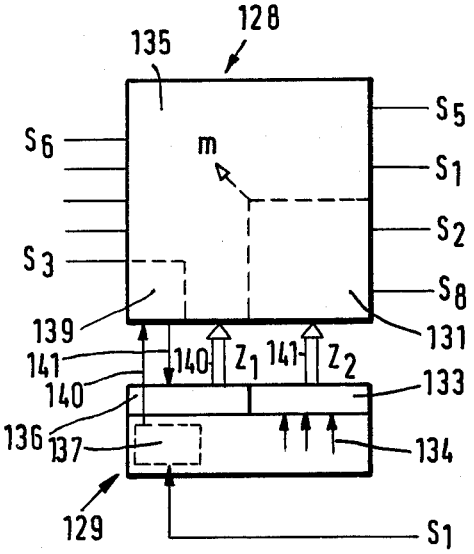
FIG. 3 is a schematic representation of another embodiment of the digital computer and input arrangement of FIG. 1.

In the modification according to FIG. 3, the same indicators are utilized; however, they are provided with the prefix "1" to give a three digit number.

Digital computer 128 comprises, in addition to calculating portion 131 for the determination of process variable m and calculation portion 135 for the determination of the turning amount signals S3 and S6, a further computation means 139. Calculating portion 139 is controlled by a program memory 137 influenced by main shaft signal S1 via path 140 and yields the setting sizes to input portion 136 of setting arrangement 129 via path 141. Also more than one machine is controlled in this embodiment.

The DC motors 13 and 22 (FIG. 1) are provided with a four quadranted correcting element so that, in accordance with the appropriate turning amount signals S3 or S6, they may be moved backwards and forwards with desired speed or brought to rest. The partial warp beams 10 are set for an appropriate number of machine rows depending upon the pattern and equally depending upon the pattern for an appropriate number of thread letoff speeds. The setting can be different for each partial warp beam. The speed of goods takeoff is similarly freely programmable and independent of the speed of thread letoff from the beam. It also may be provided with several different speeds. Continual speed changes are also possible. The free programming occurs with the help of loggers 137 or 37 which can be filled with the data as desired. When the signal generators 14 and 23 (FIG. 1) run backwards they give an additional signal to characterize the direction of rotation additionally to the pulse train. It is also possible to generate the feedback signal S2 by means of a follower roller lying on the circumference of the winding which controls the pulse generator.

Various changes in the hardware and software are contemplated. Also multiple computers may be used but a single digital calculator serving as not only the control means but also the calculating portion of the input arrangement (and/or the calculating arrangement for the turning angle feedback signal) results in simplification. There can also be provided a common data logger for the input sizes and the calculation data. By such double utilization there are substantial savings. It will be understood that various changes in the details, materials, arrangement of parts and operating conditions which have been herein described and illustrated in order to explain the nature of the invention may be made by those skilled in the art within the principles and scope of instant invention.

Having thus set forth the nature of the invention what is claimed is:

1. A control arrangement for a motor of a rotatable winding arrangement having a main shaft, comprising:

(a) a first signal generator coupled to said winding arrangement for generating a main shaft signal signifying the angular displacement of said main shaft;

(b) a second signal generator coupled to said rotatable arrangement for generating a feedback signal bearing a predetermined relation to the extent of rotation of said rotatable arrangement;

(c) input means coupled to said first signal generator and programmed to provide an input size signal that varies in response to said main shaft signal; and (d) control means coupled to said input means and said first and second signal generators for controlling the angular speed of said motor of said rotatable arrangement in response to said main shaft signal, said feedback signal and said input size signal, whereby said programmed input means can change the angular speed of said rotatable arrangement.

2. A control arrangement according to claim 1 wherein said input means comprises:

(a) a data memory having a plurality of addresses for storing different values for said input size signal; and (b) an address selector responsive to said main shaft signal for sequentially retrieving from said memory said different values for said input size signal and applying them to said control means.

3. A control arrangement according to claim 1 wherein said input means comprises:

computation means responsive to said main shaft signal for sequentially calculating different values for said input size signal in accordance with a predetermined calculating program.

4. A control arrangement according to claim 1 wherein said rotatable arrangement comprises a warp beam system of a warp knitting machine.

5. A control arrangement according to claim 4 wherein said rotatable arrangement further comprises:

(a) takeoff means for pulling knitted ware from said knitting machine; and (b) delivery means for controlling thread delivery to said knitting machine, and input means having a common program for regulating the operating speed of said delivery means and said takeoff means.

6. A control arrangement according to claim 1 wherein said control means comprises a digital computer and wherein said input means provides said input size signal digitally.

7. A control arrangement according to claim 2 wherein said motor of said rotatable arrangement is operable to reverse direction and wherein at least one of said values of said data memory upon retrieval produces from said input means said input size signal at a dimension sized to cause reverse rotation of said motor.

8. A control arrangment according to claim 7 wherein at least one of said values of said data memory upon retrieval produces from said input means said input size signal at a dimension sized to stop said motor.

9. A control arrangement according to claim 1 wherein said feedback signal signifies the magnitude of angular displacement of said rotatable arrangement.

10. A control arrangement according to claim 9 wherein said feedback signal further signifies the direction of rotation of said rotatable arrangement.

11. A control arrangement according to claim 9 wherein said rotatable arrangement comprises a beam wound with warp threads, said control arrangement further comprising:

calculating means connected to said second signal generator and responsive to its feedback signal for calculating and providing to said control means a signal corresponding to the length of thread consumed, said input means being connected to said calculating means and being preset to provide thereto signals corresponding to at least the warp diameter and the thickness of one layer of said warp threads on said beam.

12. A control arrangement according to claim 6 wherein said rotatable arrangement comprises a beam wound with warp threads and wherein said digital computer is connected to said second signal generator and is responsive to its feedback signal for calculating and adjusting the motor speed in accordance to the length of thread consumed, said input means being connected to said computer and being preset to provide thereto signals corresponding to at least the warp diameter and the thickness of one layer of said warp threads on said beam.

13. A control arrangement according to claim 12 wherein said digital computer includes:

computation means connected to said first signal generator and responsive to its main shaft signal for sequentially calculating different values for said input size signal in accordance with a predetermined calculating program.

14. A control arrangement according to claim 13 wherein said input means comprises:

a common data memory for providing to said digital computer different values for said input size signal, said data memory being preset to provide to said digital computer signals corresponding to at least the warp diameter and the thickness of one layer of said warp threads on said beam.

15. A control arrangement according to claim 14 further comprising:

a counter driven by said second signal generator for providing to said computer a signal signifying the elapsed rotation of said rotatable arrangement.

16. A control arrangement according to claim 4 wherein said rotatable arrangement includes:

takeoff means for pulling knitted ware from said knitting machine.

* * * * *